US009831032B2

(12) United States Patent
Knab

(10) Patent No.: US 9,831,032 B2
(45) Date of Patent: Nov. 28, 2017

(54) GAS-INSULATED MEASUREMENT TRANSFORMER HAVING A SEPARATING DEVICE

(71) Applicant: SIEMENS AKTIENGESELLSCHAFT, Munich (DE)

(72) Inventor: Wolfgang Knab, Hallstadt (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/104,634

(22) PCT Filed: Dec. 12, 2014

(86) PCT No.: PCT/EP2014/077497
§ 371 (c)(1),
(2) Date: Jun. 15, 2016

(87) PCT Pub. No.: WO2015/091239
PCT Pub. Date: Jun. 25, 2015

(65) Prior Publication Data

US 2016/0322157 A1 Nov. 3, 2016

(30) Foreign Application Priority Data

Dec. 20, 2013 (EP) ..... 13198957

(51) Int. Cl.
*H01F 38/38* (2006.01)
*H01H 1/38* (2006.01)
(Continued)

(52) U.S. Cl.
CPC ..... *H01F 38/38* (2013.01); *H01F 27/04* (2013.01); *H01F 38/26* (2013.01); *H01H 1/385* (2013.01)

(58) Field of Classification Search
CPC ..... H01F 27/00–27/30
(Continued)

(56) References Cited

U.S. PATENT DOCUMENTS 7,199,686 B1 * 4/2007 Tsai ..... H01H 33/75 335/37
7,357,656 B2 4/2008 Andermatt et al.
(Continued)

FOREIGN PATENT DOCUMENTS

CN 101625937 A 1/2010
CN 102667993 A 9/2012
(Continued)

*Primary Examiner* — Tuyen Nguyen
(74) *Attorney, Agent, or Firm* — Laurence Greenberg; Werner Stemer; Ralph Locher

(57) ABSTRACT

A gas-insulated measurement transformer for measuring high voltages has a plurality of transformer arrays arranged in a fluid-tight housing for transforming a high voltage to a measurement voltage. Each of the arrays has an active part, a high voltage contact guided through the housing, a fixed contact that is electrically connected to the active part, a movable contact that is electrically connected to the fixed contact, and a separating device, which can be operated from outside the housing, for establishing or separating a connection between the movable contacts and the high voltage contacts. The separating device has a connecting element connecting the movable contacts to one another, and an adjustment device for moving the connecting element in an actuating direction, wherein the fixed contact is configured as a guiding device for the movable contact in an actuating direction.

8 Claims, 5 Drawing Sheets

(51) Int. Cl.
*H01F 38/26* (2006.01)
*H01F 27/04* (2006.01)

(58) Field of Classification Search
USPC ..... 336/55–62, 90
See application file for complete search history.

(56) References Cited

U.S. PATENT DOCUMENTS

| | | | |
|---|---|---|---|
| 2005/0258140 | A1 | 11/2005 | Andermatt et al. |
| 2013/0248338 | A1 | 9/2013 | Belloni et al. |

FOREIGN PATENT DOCUMENTS

| | | | | | |
|---|---|---|---|---|---|
| CN | 103098154 | A | | 5/2013 | |
| CN | 103367016 | A | | 10/2013 | |
| DE | 2758455 | B1 | | 3/1979 | |
| DE | 102011007900 | A1 | | 10/2012 | |
| EP | 1610352 | A1 | | 12/2005 | |
| EP | 2144261 | A1 | | 1/2010 | |
| EP | 2346053 | A1 | | 7/2011 | |
| FR | 2953984 | A1 | | 6/2011 | |
| GB | 548306 | A | * | 10/1942 | ..... H01H 31/32 |
| JP | S61135433 | U | | 8/1986 | |
| JP | 2004022557 | A | | 1/2004 | |
| WO | 2011161129 | A1 | | 12/2011 | |

* cited by examiner

GAS-INSULATED MEASUREMENT TRANSFORMER HAVING A SEPARATING DEVICE

BACKGROUND OF THE INVENTION

Field of the Invention

Measurement transformers for use in a gas-insulated high voltage switching system have an active part which is arranged in a fluid-tight housing and is connected to the switching system and to an evaluation unit. During tests of the switching system, the connection between active part and the switching system has to be separated since otherwise the active part could be damaged. Single-phase measurement transformers having an active part in a housing and multi-phase, generally three-phase, measurement transformers which have a plurality of active parts arranged in a rotationally symmetrical manner in the housing have been known up to now. Various separating devices are known for said measurement transformers.

DE 10 2011 007 900 A1 describes a single-phase voltage transformer having a pivoting arm which establishes or separates a connection of the active part to or from the switching system.

EP 1 610 352 A1 presents a multi-phase measurement transformer in which the connection between active part and switching system can be established or separated by a lateral movement, i.e. perpendicularly to the direct connecting line between active part and switching system. In another embodiment, contacts which are connected to one another via a carrier and are connected to the active part via a flexible cable are moved by means of a push rod in a direction parallel to the connecting line between active part and switching system, and the connection is thus established or separated.

BRIEF SUMMARY OF THE INVENTION

It is the object of the invention to specify a measurement transformer having a plurality of active parts with an improved separating device.

According to the invention, a gas-insulated measurement transformer, which serves for measuring high voltages, is provided for this purpose. The measurement transformer has a plurality of transformer arrays arranged in a fluid-tight housing for transforming a high voltage into a measurement voltage. Each transformer array comprises an active part, a high voltage contact guided through the housing, a fixed contact which is electrically connected to the active part and a movable contact which is electrically connected to the fixed contact. In addition, the measurement transformer comprises a separating device, which can be operated from outside the housing, by means of which a connection between the movable contacts and the high voltage contacts can be established or separated. For this purpose, the separating device has a connecting element connecting the movable contacts to one another, and adjustment means for moving the connecting element in an actuating direction. A movement transmitted to the connecting element by means of the adjustment means thus leads to a synchronous movement of the movable contacts in the actuating direction. The fixed contact is designed here as a guiding means for the movable contact in the actuating direction. The movement is preferably a linear movement, and the guiding means is designed as a linear guiding means. The guiding means can be designed, for example, in the form of tongue and groove, as a dovetail guiding means, as a rail guiding means, as a rolling guiding means, as a plain bearing guiding means or as a telescopic guiding means. During the movement of the movable contact, good electrical contact between movable contact and fixed contact is established by means of the guiding means. In addition, the guiding means serves to enable the movement of the movable contact in the actuating direction and to restrict a movement in a direction perpendicularly to the actuating direction. As a result of the fact that the guiding means of the movable contact is produced by the fixed contact, the mechanical outlay is reduced and good electrical contact between movable contact and fixed contact is ensured.

The fixed contact advantageously has a tubular end and the movable contact has a rod-shaped end, the rod-shaped end can be pushed here into the tubular end. This permits particularly simple installation of the separating device and provides particularly good guidance of the movable contact. The electrical connection can be produced, for example, by spring contacts or lamellar contacts.

In a preferred embodiment, the adjustment means have a push rod which is connected to the connecting element and is movable in the actuating direction by means of a drive arranged outside the housing. The push rod transmits the movement of the drive to the connecting element which, in turn, transmits its movement to the movable contacts, as a result of which a synchronous movement of the movable contacts is achieved in a particularly simple manner.

Furthermore, it is preferred that the drive is coupled to the push rod via a gearing which converts a rotating movement of the drive into a linear actuating movement of the push rod. For this purpose, the gearing is preferably arranged in the interior of the housing and can be, for example, an eccentric gearing, a worm gearing or a trapezoid thread gearing. A rotating movement is therefore transmitted by the drive into the interior of the housing, said movement being converted there into a linear movement. This reduces the space required for the drive, and a rotating movement can be guided more simply in a gas-tight manner through the housing wall than a linear movement.

The gearing is particularly advantageously designed as an eccentric gearing since the latter is constructed and can be mounted particularly simply.

Furthermore, in an advantageous refinement of the invention, at least two push rods which are arranged parallel to each other and are movable simultaneously by means of the drive are connected to the connecting element, as a result of which better protection against tilting of the connecting element is achieved. This could be achieved, for example,by one of the push rods being coupled to the gearing and the two push rods being connected to each other, but it is considered advantageous if each of the at least two push rods is coupled to the drive via a gearing.

Furthermore, it is preferred that the active parts are arranged in a row with respect to one another in such a manner that they have a common winding axis. The active parts are of disk-like construction in a rotationally symmetrical manner about the winding axis which runs through a core limb. As a result, all of the core limbs lie in a plane in which the winding axis also runs. The winding plane lies perpendicularly to said plane. This permits a particularly space-saving arrangement of the active parts and a particularly simply constructed supporting frame structure for the cores.

It is also preferred that the drive is coupled to the gearing via a drive shaft arranged perpendicularly to the actuating direction. This permits a particularly space-saving arrangement of the drive.

Furthermore, it is preferred for the drive to have a device for limiting the angle of rotation. As a result, the possible angle of rotation of the drive shaft is restricted by means of two stops in such a manner that the separating device is closed in one end position and is maximally open in the other.

In addition, the drive can have a display indicating the position of the separating device.

BRIEF DESCRIPTION OF THE SEVERAL VIEWS OF THE DRAWING

The invention is explained in more detail below with reference to the drawings, in which.

DESCRIPTION OF THE INVENTION

Parts corresponding to one another are provided with the same reference signs in all of the figures.

The figures show a specific embodiment for illustrative purposes. However, the invention is not restricted thereto.

Figure 1:
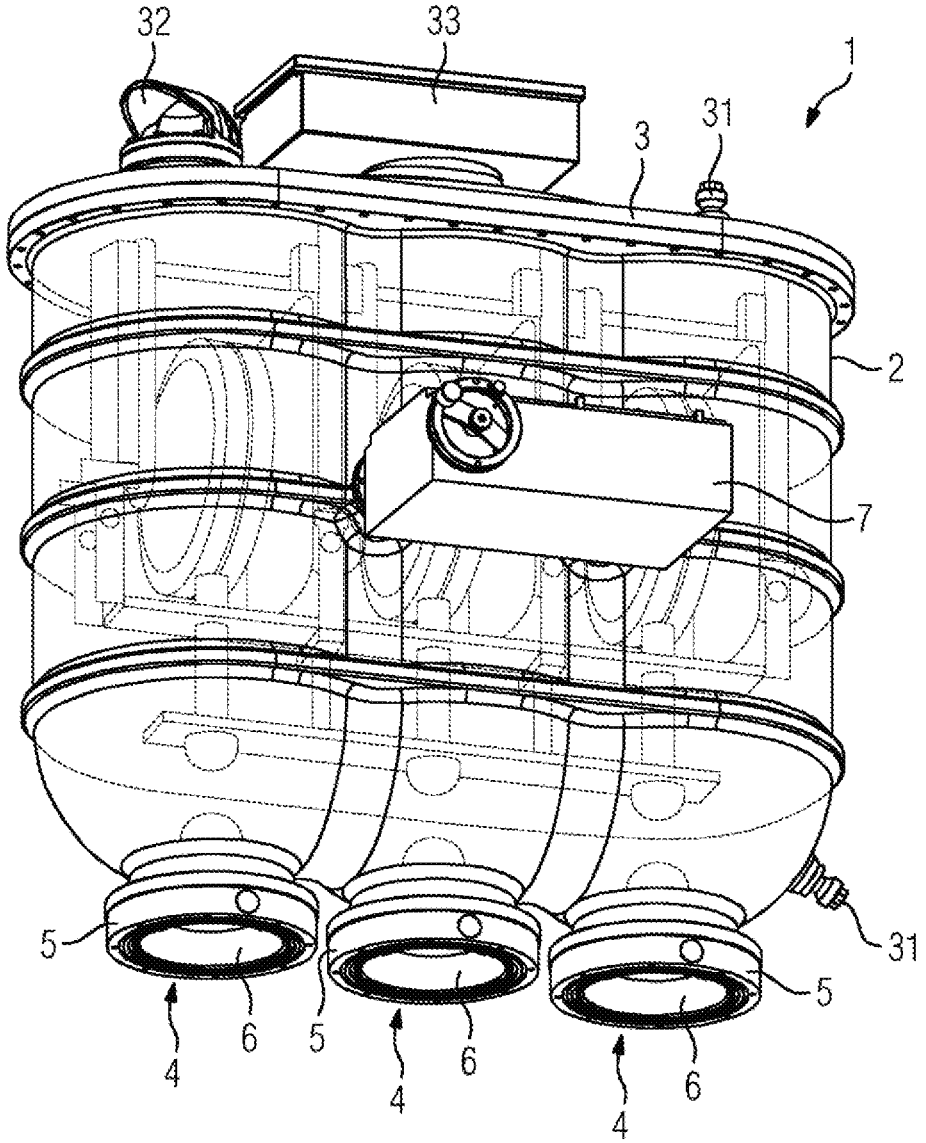
FIG. 1 shows a partial sectional illustration of a voltage transformer according to the invention.

FIG. 1 shows a measurement transformer 1 according to the invention with a gas-insulated housing 2, which is illustrated in partially transparent form here. The housing 2 has an oval cross section and is closed at one end by a cover 3. Three openings provided with leadthroughs 4 are located at the end opposite the cover 3. The leadthroughs have an insulating body 5 and a high voltage contact 6 guided through the latter in a gas-tight manner. The housing can have further devices, such as valves 31, positive pressure outlet devices 32 or a secondary connection box 33. In addition, a drive 7 is arranged on the outer side of a housing wall. In the following, the view from the side of the measurement transformer 1 with the drive 7 is referred to as front view, the view from the opposite side as the rear view.

Figure 2:
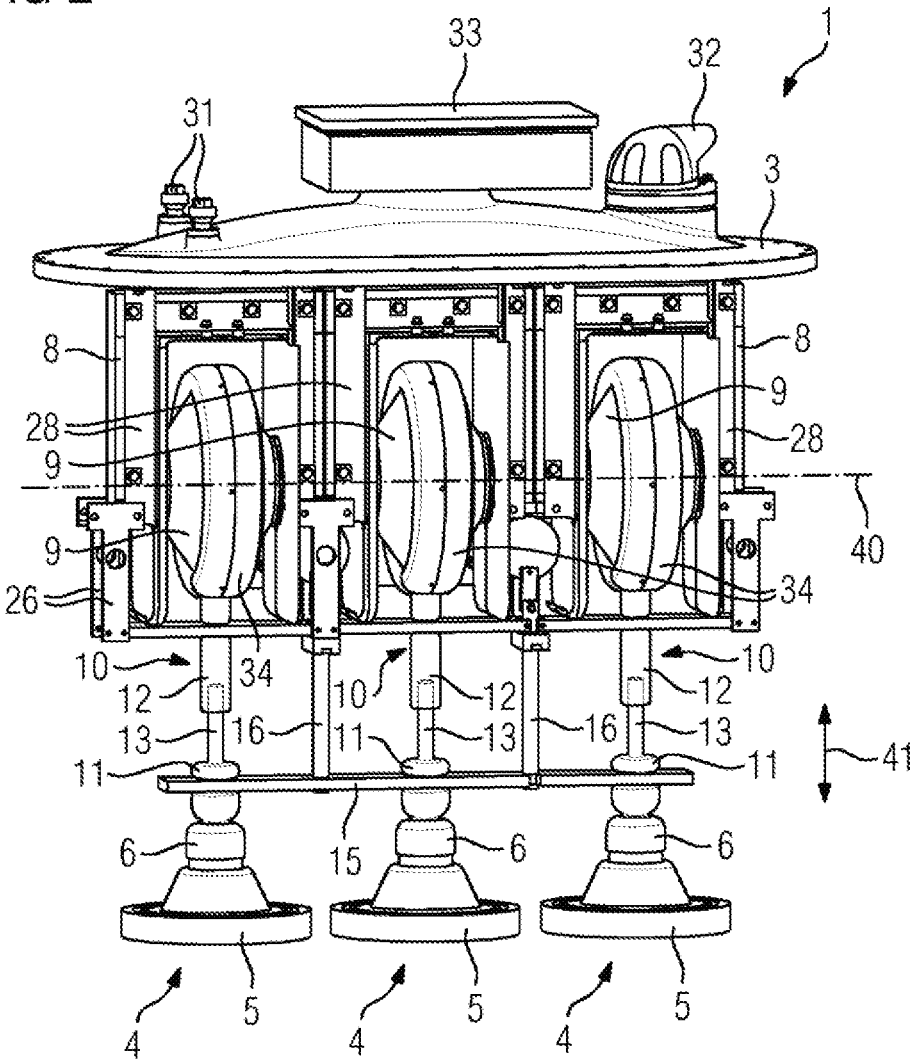
FIG. 2 shows a detailed illustration of a cutout from FIG. 1.
Figure 3:
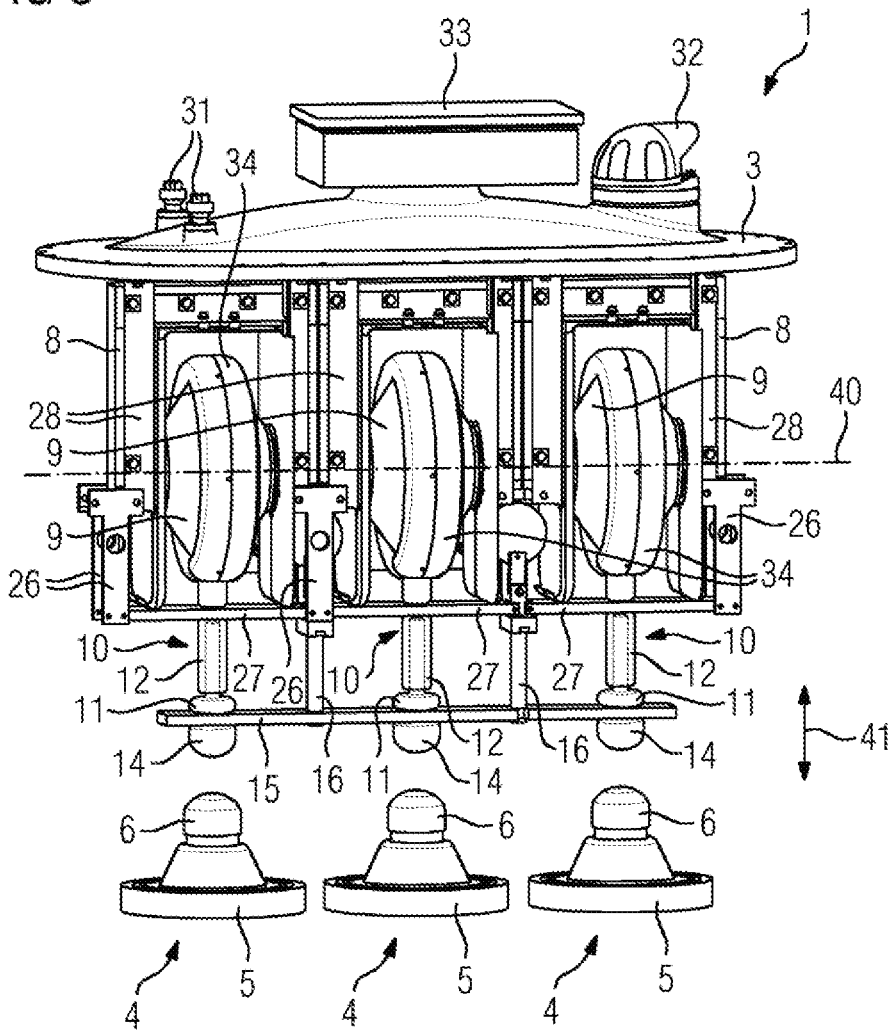
FIG. 3 shows an alternative embodiment of a voltage transformer according to the invention.

FIGS. 2 and 3 show the rear view of the measurement transformer 1 from FIG. 1, wherein, of the housing 2, only the cover 3 is illustrated here. Three cores 8 composed of laminated iron sheets are located in the interior of the housing. The cores 8 are each held by a frame 28 fastened to the cover 3. Each core 8 consists of in each case two horizontal and two vertical limbs arranged in a rectangle. An active part 9 is arranged on in each case one horizontal limb, the lower limb in the figures, of each core 8. The active parts 9 here are inductive voltage transformers having in each case a primary winding and one or more secondary windings which are wound about a winding axis 40. The winding plane runs perpendicularly to the winding axis 40. The primary winding is connected to a conductor which is guided through the high voltage leadthrough 4 into the housing 2 and is connected in turn to a high voltage line. The secondary winding is connected to the secondary connection box 33 via connection cables through a leadthrough (not visible here) arranged in the cover 3. An annular high voltage electrode arranged around each active part 9 shields the cores 8 and frames 28, which are at ground potential, from the high voltage potential. The active parts 9 are arranged in a row with respect to one another, and therefore the winding planes are arranged parallel to one another. The limbs on which the windings are arranged are arranged longitudinally one behind another along the winding axis 40. The three active parts 9 are provided in order to transform the voltage of the three phases of a high voltage line to a measurement voltage which is simple to measure. The high voltage here is from a few tens of kilovolts to several hundred kilovolts. The active parts 9 transform said high voltage with a high degree of accuracy to a value significantly under a thousand volts, generally approximately one hundred volts, when a nominal voltage is applied. For this purpose, the primary windings of the active parts 9 are connected to a respective phase of the high voltage line. This connection has to be able to be separated for testing purposes. FIG. 2 shows the connection in the closed state and FIG. 3 shows same in the open state.

The high voltage is conducted into the housing 2 via the high voltage contacts 6. The high voltage contacts 6 are conductor pieces which are guided in a gas-tight manner through the insulating bodies 5 of the leadthroughs 4.

The primary windings of the active parts 9 are each electrically connected to a fixed contact 10. The connection can be established, for example, via a spring contact connected to the fixed contact 10. The fixed contact 10 has a tubular end 12 into which a rod-shaped end 13 of a movable contact 11 is inserted. The rod-shaped end 13 can move telescopically in an actuating direction 41 into the tubular end 12 and out therefrom. The rod-shaped end 13 is preferably guided in the tubular end 12. Alternative embodiments are possible. For example, the fixed contact could have a rod-shaped end 13 and the movable contact could have a tubular end 12, or one of the contacts has a groove and the other has a corresponding tongue guided in the groove.

In each case one active part 9 having a core 8 forms, together with a high voltage contact 6, a fixed contact 10 and a movable contact 11, a transformer arrangement within the context of the invention.

In the closed state, an approximately spherical contact piece 14 of the movable contact 11 is in contact with the high voltage contact 6 and establishes an electrical connection of the high voltage contact 6 via the movable contact 11 and the fixed contact 10 with the primary winding of the active part 9. The high voltage contact 6 can have a depression, which is in the shape of a spherical portion, for receiving the contact piece 14 in order to enlarge the contact surface therewith. The rod-shaped end 13 of the movable contact 11 is pulled here out of the tubular end 12 of the fixed contact 10. Only a small piece of the rod-shaped end 13, indicated in FIG. 2 by dashed lines, remains in the tubular end 12.

In the open state, as shown in FIG. 3, the rod-shaped end 13 is pushed virtually completely into the tubular end 12, as indicated by the dashed lines. The contact pieces 14 are now at a distance from the high voltage contact 6, and the electrical connection of the high voltage contact 6 with the primary windings of the active parts 9 is therefore separated. The size of the distance depends here on plant-specific parameters, such as the applied high voltage, and the type and the pressure of the insulating gas used.

Above the contact pieces 14, the movable contacts 11 are connected by a movable bar, as connecting element 15, parallel to the winding axis 40. One or more push rods 16 is/are connected to the connecting element 15 perpendicularly to the connecting element 15. The push rod 16 is coupled to a separating mechanism which is explained below and by means of which the push rod 16 is movable perpendicularly to the winding axis 40. The movement of the push rod 16 is transmitted here to the connecting element 15; the latter transmits the movement to the movable contact 11.

Pairs of holding plates 26 which hold horizontal connecting webs 27 are fastened to the vertical limbs of the cores 8 or to the frames 28. The connecting webs 27 run parallel to the winding axis 40. The fixed contacts 10 penetrate said connecting webs 27 and are secured therein. The push rod 16 runs between in each case two fixed contacts 10 either between two connecting webs 27, in the intermediate space therebetween, or penetrates the connecting webs 27 through an opening therein. Guide sleeves 30 for the push rods 16 can be arranged on the holding plates 26 or on the connecting webs 27.

Figure 4:
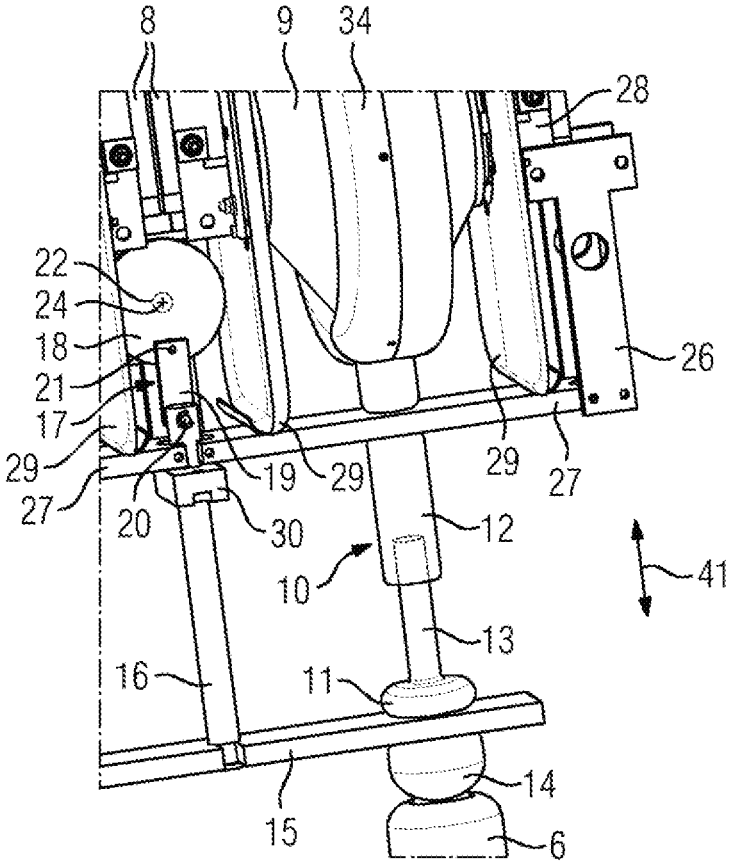
FIG. 4 shows a detailed illustration of a further cutout from FIG. 1.
Figure 5:
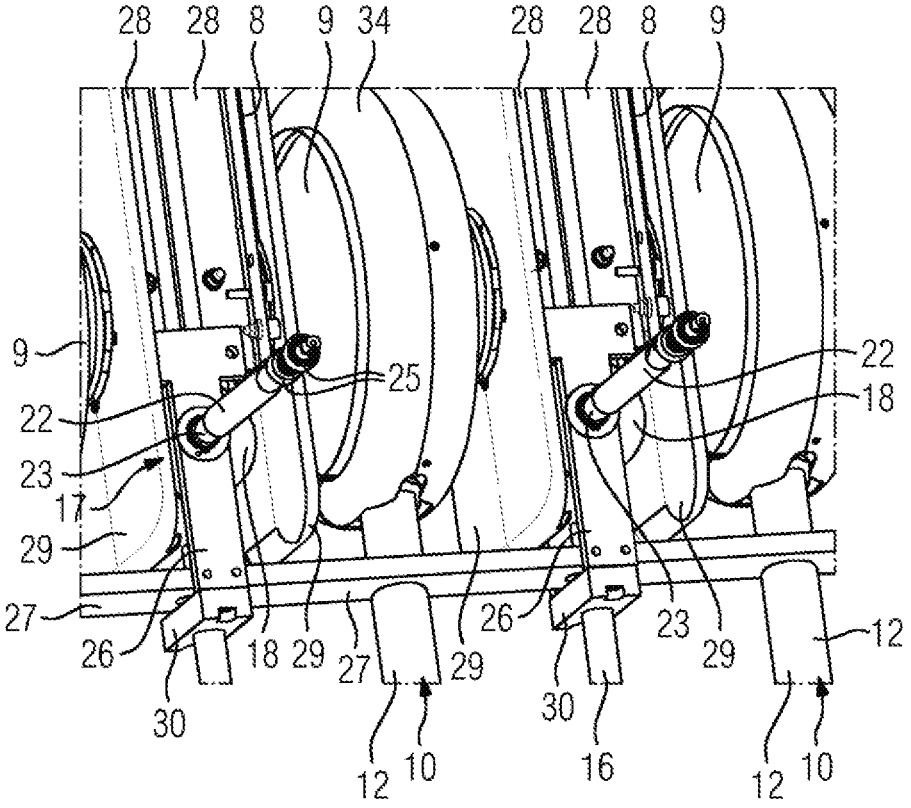
FIG. 5 shows a detailed illustration of another cutout from a front view of FIG. 1.

FIG. 4 shows a cutout from FIG. 2, like the latter in rear view, and FIG. 5 shows a similar cutout of the same measurement transformer 1, but in the front view in comparison to FIG. 4. The separating mechanism consists of a gearing 17, which is an eccentric gearing here, and at least one drive shaft 22 which is coupled to the gearing 17. Other types of gearing, for example a trapezoid thread gearing, are likewise possible. The drive shaft 22 is guided outward in a gas-tight manner through a housing wall and is connected outside the housing 2 to the drive 7. Bearing bushings which receive bearings 25, for example ball bearings, which are arranged around the drive shaft 22 are arranged in the housing wall. O-rings between the bearings 25 produce the gas tightness. The drive shaft 22 is preferably produced from an electrically non-conductive material, such as casting resin. The drive 7 can be, for example, a manual drive or an electric-motor drive. The drive 7 may also contain a gearing. The drive 7 can set the drive shaft 22 into a rotating movement. The drive shaft transmits this movement to an eccentric gearing 17 which converts the rotating movement into a linear movement. The eccentric gearing 17 has an eccentric disk 18 and an eccentric arm 19. One end of the drive shaft 22 is connected to a central axis 24 of the eccentric disk 18. The second end of the drive shaft 22 is connected to the drive 7. An eccentric axis 21 is arranged on the eccentric disk 18 eccentrically with respect to the central axis 24. The eccentric arm 19 is mounted rotatably at a first end on said eccentric axis 21. A second end of the eccentric arm 19 is coupled rotatably via a coupling pin 20 to the push rod 16. The push rod 16 is restricted to vertical movements by means of the guide sleeve 30. A rotation transmitted by means of the drive 7 to the drive shaft 22 is thus transmitted to the eccentric disk 18. The distance of the eccentric axis 21 from the central axis 24 determines the possible stroke of the push rod 16 and therefore the maximum distance of the movable contact 11 from the high voltage contact 6. Starting from the position illustrated in FIG. 4, the eccentric arm 19 is displaced from a lower position, illustrated in FIG. 4, into an upper position by rotation of the eccentric disk 18. The eccentric disk 18 is rotated here through 180° about the central axis 24. The eccentric axis likewise rotates here through 180° about the central axis 24 and carries along the eccentric arm 19. Since the eccentric arm 19 is coupled at the second end to the push rod 16 which, in turn, is restricted to vertical movements, the coupling pin 20 always remains below the eccentric axis 21 during the rotation. The push rod 16 is thus moved upward in the direction of the eccentric disk 18. The push rod 16 transmits this vertical movement via the movable bar to the movable contacts 11 which are thereby moved away from the high voltage contact 6. The electrical connection between high voltage contact 6 and movable contact 11 is thereby separated, and therefore the primary windings are also separated from the high voltage. Further rotation of the drive shaft 22, irrespective of in which direction, leads to the opposed movement of the push rod 16 and, in the event of rotation through 180°, reestablishes the connection.

The drive shaft 22 is guided by a holding plate 26 and is connected to the eccentric disk 18 by a phase angle error compensating coupling 23. FIGS. 2 and 4 do not illustrate a holding plate 26, in order to better illustrate the separating mechanism. The eccentric gearing 17 is arranged in the region below two mutually adjacent vertical limbs of adjacent cores 8. A shielding plate 29 between the active part 9 and the vertical limbs of the associated core 8 shields the limbs from the high voltage applied to the active part 9. The shielding plates 29 are guided further beyond the vertical limbs and thus also shield the eccentric gearing 17 and the holding plates 26 from the high voltage. The rod-shaped ends 13 of the movable contacts 11 are guided in the tubular ends 12 of the fixed contacts 10 in order to protect against tilting. For the low-friction guidance and at the same time for establishing the electrical connection between fixed contact 10 and movable contact 11, lamellar contacts, for example, can be arranged in the tubular end 12. The fixed contacts 10 thus act as a linear guiding means for the movable contacts 11.

FIG. 5 shows that the measurement transformer 1 has two eccentric gearings 17 which are each driven by a drive shaft 22. The drive shafts 22 are moved synchronously by the drive 7. This can take place in the same or else in an opposed direction of rotation. The synchronization can take place in the drive 7 by means of a belt, a chain or a gearing.

Push rod 16, gearing 17 and drive shaft 22 form the adjustment means by means of which the connecting element 15 is moved in the actuating direction 41.

The eccentric gearing 17 and the holding plates 26 are preferably manufactured from a high-strength material, such as steel. The push rods 16, the connecting element 15, the connecting web 27 and the guide sleeves 30 are preferably manufactured from an electrically non-conductive material, such as plastic, for example polyoxymethylene, which has high rigidity, low friction values and excellent dimensional stability and thermal stability.

The invention claimed is:

1. A gas-insulated measurement transformer for measuring high voltages, comprising:

a fluid-tight housing;

a plurality of transformer arrays disposed in said fluid-tight housing for transforming a high voltage into a measurement voltage, each of said transformer arrays having an active part, a high voltage contact guided through said fluid-tight housing, a fixed contact electrically connected to said active part and a movable contact electrically connected to said fixed contact;

a separating device operated from outside said fluid-tight housing for establishing or separating a connection between said movable contact and said high voltage contact, said separating device containing a connecting element connecting movable contacts to one another and an adjustment device for moving said connecting element in an actuating direction; and wherein said fixed contact is a guiding device for said movable contact in the actuating direction, said fixed contact has a tubular end and said movable contact has a rod-shaped end, and wherein said rod-shaped end can be pushed into said tubular end.

2. A gas-insulated measurement transformer for measuring high voltages, comprising:

a fluid-tight housing;

a plurality of transformer arrays disposed in said fluid-tight housing for transforming a high voltage into a measurement voltage, each of said transformer arrays having an active part, a high voltage contact guided through said fluid-tight housing, a fixed contact electrically connected to said active part and a movable contact electrically connected to said fixed contact;

a separating device operated from outside said fluid-tight housing for establishing or separating a connection between said movable contact and said high voltage contact, said separating device containing a connecting element connecting movable contacts to one another and an adjustment device for moving said connecting element in an actuating direction; and a drive disposed outside said housing; and wherein said fixed contact is a guiding device for said movable contact in the actuating direction; and wherein said adjustment device has a push rod which is connected to said connecting element and is movable in the actuating direction by means of said drive.

3. The gas-insulated measurement transformer according to claim 2, further comprising a gearing for converting a rotating movement of said drive into a linear actuating movement of said push rod, said drive is coupled to said push rod via said gearing.

4. The gas-insulated measurement transformer according to claim 3, wherein said gearing is an eccentric gearing.

5. The gas-insulated measurement transformer according to claim 3, wherein said push rod is one of at least two push rods which are disposed parallel to each other and are movable simultaneously by means of said drive and are connected to said connecting element.

6. The gas-insulated measurement transformer according to claim 5, wherein each of said at least two push rods is coupled to said drive via said gearing.

7. A gas-insulated measurement transformer for measuring high voltages, comprising:

a fluid-tight housing;

a plurality of transformer arrays disposed in said fluid-tight housing for transforming a high voltage into a measurement voltage, each of said transformer arrays having an active part, a high voltage contact guided through said fluid-tight housing, a fixed contact electrically connected to said active part and a movable contact electrically connected to said fixed contact;

a separating device operated from outside said fluid-tight housing for establishing or separating a connection between said movable contact and said high voltage contact, said separating device containing a connecting element connecting movable contacts to one another and an adjustment device for moving said connecting element in an actuating direction; and wherein said fixed contact is a guiding device for said movable contact in the actuating direction; and wherein said active part of each of said transformer arrays is disposed in a row with respect to one another in such a manner that they have a common winding axis.

8. The gas-insulated measurement transformer according to claimed in claim 3, further comprising a drive shaft disposed perpendicularly to the actuating direction, said drive is coupled to said gearing via said drive shaft.

* * * * *